US007674973B2

(12) United States Patent
Cardas

(10) Patent No.: US 7,674,973 B2
(45) Date of Patent: Mar. 9, 2010

(54) ELECTRICAL CONDUCTOR AND CABLE UTILIZING SAME

(76) Inventor: George Cardas, 480 Eleventh St. SE., Bandon, OR (US) 97411

( * ) Notice: Subject to any disclaimer, the term of this patent is extended or adjusted under 35 U.S.C. 154(b) by 0 days.

(21) Appl. No.: 12/106,133

(22) Filed: Apr. 18, 2008

(65) Prior Publication Data

US 2009/0260849 A1 Oct. 22, 2009

(51) Int. Cl.
*H01B 7/00* (2006.01)

(52) U.S. Cl. ..... 174/36; 174/102 R; 174/108

(58) Field of Classification Search ..... 174/102 R, 174/105 R, 107, 108
See application file for complete search history.

(56) References Cited

U.S. PATENT DOCUMENTS 2,769,149 A 10/1956 Kreer, Jr.
4,628,151 A 12/1986 Cardas ..... 174/114
4,701,730 A 10/1987 Okamoto
4,980,517 A 12/1990 Cardas ..... 174/127
4,997,992 A 3/1991 Low
5,929,374 A * 7/1999 Garland ..... 174/28
7,329,814 B2 * 2/2008 Hacker ..... 174/110 R

* cited by examiner

*Primary Examiner*—William H Mayo, III
(74) *Attorney, Agent, or Firm*—Dorsey & Whitney LLP

(57) ABSTRACT

A conductor includes a central element having a length, a plurality of insulated strands disposed about the central element in at least first and second concentric layers, a layer of a dielectric material having a velocity of propagation disposed around the plurality of insulated strands. Each of the plurality of insulated strands has a conductive element and a layer of insulative material disposed around the conductive element and a length approximately equal to an inverse of the velocity of propagation of associated dielectric materials multiplied by the product of the length of the central element and the number one hundred.

21 Claims, 6 Drawing Sheets

ELECTRICAL CONDUCTOR AND CABLE UTILIZING SAME

FIELD

The present invention relates to electrical conductors and more particularly to electrical conductors with multiple conductive strands.

BACKGROUND

Generally, an electric cable may hold a charge in many ways. For example, a charge may be held in an empty space or air between conductor tracks. Another way a charge may be held is in dielectric polarizations or mechanical stresses. At low frequencies charges often scatter towards a steady state in a statistically randomized event like white noise due to polarization mechanisms that move and orientate dielectric structures. The impact of this noise may be exaggerated by the sequential decay in a cable's dielectric and fueled by the conductor/dielectric transition time differential. This effect causes dielectric constants to drop with frequency, adding noise and jitter to a transmitted signal.

Signal propagation in a cable is generally governed by an interaction between one or more conductors and an insulating dielectric material. The signal propagating on the conductor needs to charge the surrounding dielectric material. Problems can arise when an electromagnetic wave propagates at different velocities in a conductor and an adjacent dielectric. As energy is stored and transferred at different time constants in conductors and dielectrics, a complex kinetic resonator can result, impeding performance of the cable.

In the early development of cable technology, load coils were placed in series with cable conductors at intervals along the length of the conductor. These load coils slowed the conductor to better match propagation in the dielectric. However, the load coils were bulky and caused the cable to lose dynamic range, bandwidth, and signal intensity. In particular, the load coils severely limited high frequency signal transmission because they acted as inductors and choked the line.

What is needed, therefore, is an electrical cable with a conductor having evenly distributed inductance and propagation delay, to match its wave propagation velocity to the dielectric materials in the cable.

SUMMARY

In general, embodiments of the present invention provide conductors. One embodiment of a conductor includes a central element having a length, a plurality of insulated strands disposed about the central element in at least first and second concentric layers, and a layer of a dielectric material having a velocity of propagation disposed around the plurality of insulated strands. Each of the plurality of insulated strands has a conductive element and a layer of insulating material disposed around the conductive element and a length approximately equal to an inverse of the velocity of propagation of an electromagnetic field in the dielectric material multiplied by the product of the length of the central element and the number one hundred.

As will be realized by those of ordinary skill in the art upon reading the entirety of this disclosure, the invention is capable of modifications in various aspects, all without departing from the spirit and scope of the present invention. Accordingly, the drawings and detailed description are to be regarded as illustrative in nature and not restrictive.

BRIEF DESCRIPTION OF THE DRAWINGS

The accompanying drawings, which are somewhat schematic in many instances and are incorporated in and form a part of this specification, illustrate several embodiments of the invention and, together with the description, serve to explain the principles of the invention.

DETAILED DESCRIPTION OF VARIOUS EMBODIMENTS

Figure 1:
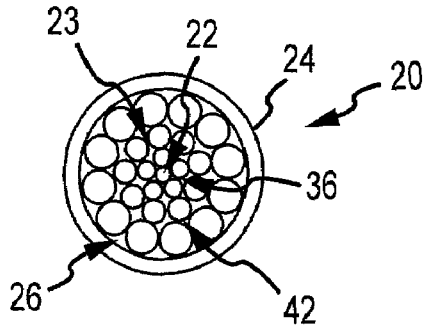
FIG. 1 is a cross-sectional view of an exemplary conductor.

In general, an exemplary conductor is provided. The conductor is capable of being used in a multiple-strand cable. The conductor may be used in many applications including electrical power transmission lines, electrical signal transmission lines, and audio signal cables or speaker cables.

Embodiments of conductors described herein are designed to more closely match a velocity of signal propagation along the conductor to the velocity of signal propagation in an adjacent dielectric. The conductor includes a plurality of conductive strands, where the strand lengths are selected such that a ratio of the strand length to conductor length is proportional to an inverse of the velocity of propagation in the adjacent dielectric. Embodiments of conductors described have generally uniform construction along their length. That is, the conductor's impedance is relatively constant per unit length of conductor. This is unlike load coils placed at discrete intervals where the impedance of the cable is much higher at the load coil than the remainder of the cable. The conductive strand length is increased relative to the conductor length in some embodiments by winding one or more strands around a central element a certain number of turns per unit length sufficient to arrive at the desired length, based on the velocity of propagation in the dielectric and circumference of the strand layer. In other embodiments, the increased strand length is achieved by etching a conductive material in an angled pattern such that the desired strand length is achieved per unit length of conductor. Generally, the strand length is chosen relative to the conductor length such that a velocity of propagation in the strand, measured along the conductor's length will approximately equal the velocity of propagation in an adjacent dielectric. By matching a velocity of propagation along a conductor with the velocity of propagation in an adjacent, dielectric, embodiments of conductors according to the present invention may reduce or substantially eliminate certain resonance effects in the conductor/dielectric system. Embodiments of a conductor according to the present invention may include a plurality of strands of a conductive material. The plurality of strands may include at least two concentric layers of strands disposed around a central element. The central element may be a conducting material or a non-conducting material. Surrounding the plurality of strands is a layer of a dielectric material in which an electromagnetic signal has a certain, limited, velocity of propagation. The central element has a length and the strands in at least two concentric layers each have a length approximately equal to an inverse of the velocity of propagation multiplied by the product of the length of the central element and the number one hundred. As will be described below, although the concentric layers have different cross-sectional areas, the conductive strand length is approximately the same in each layer.

A conductor 20, as shown in FIG. 1, is provided. The conductor 20 may include a central member 22, a dielectric material 24, and a plurality of strands 26 disposed between the dielectric material 24 and the central member 22. The central member 22 has a length and a diameter or other transverse dimension. The central member 22 may include a conductive material 23. The conductive material of the central member 22 may be formed from a strand made of copper, aluminum or both. Additionally, the central member 22 may include either a bare wire or a non-conductive strand. Whether the central member 22 is insulated or not may depend on, among other things, the application in which the conductor is used. For example, electrical power transmission lines may be formed from aluminum requiring the central member 22 to be made of steel for strength. On the other hand electrical signal transmission lines, audio or data cables may be formed from copper or silver and require a bare or non conductive strand.

Figure 2:
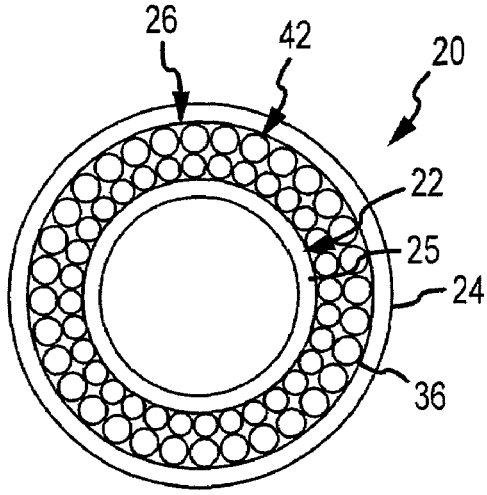
FIG. 2 is a cross-sectional view of an additional embodiment of an exemplary conductor.

Alternatively, the central member 22 may include a non-conductive member 25 having a diameter as shown in FIG. 2. More specifically, the central member 22 may include a tube-like member. The central member 22 may be made of a dielectric material.

Figure 3:
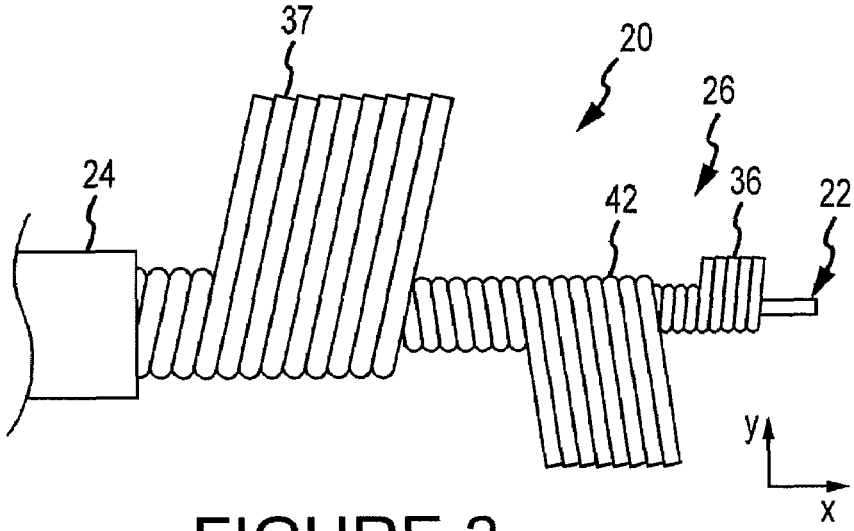
FIG. 3 is a side view of the exemplary conductor in FIG. 1 with a dielectric material partially removed for ease of illustration and a plurality of strands in a partially unwound state for ease of illustration.

Each of the plurality of strands 26 are conductive strands and would have a thin insulative coating (e.g. Magnet wire) (not shown in FIG. 1). The plurality of strands 26 may include a first concentric layer 36 of strands disposed adjacent and around the central member 22 as shown in FIGS. 1-3. The first concentric layer 36 may include a diameter and a length. The strands of the first concentric layer 36 may have the same diameter. The strand diameter of the first concentric layer 36 may be equal to the diameter of the central member 22. In one embodiment, if the central member 22 is a conducting member 23, the strands of the first concentric layer 36 may be larger in diameter than the diameter the central member 22 as shown in FIG. 1. The strands of the first concentric layer 36 are in close proximity to or contact one another circumferentially. In another embodiment, if the central member 22 is a non-conducting member 25, the diameter of the central member 22 may be larger than the diameter of individual strands of the first concentric layer 36 as shown in FIG. 2.

The plurality of strands 26 may also include a second concentric layer 42 of strands disposed around the first concentric layer 36 of strands and the central element 22. In other words, as shown in FIGS. 1-3, the strands of the first or inner layer 36 of strands contact the central member 22 and the strands in the second or outer layer 42 of strands contact the inner layer 36 of strands. The first concentric layer 36 of strands may be wound helically around the central element 22, while the second concentric layer 42 is wound counter-helically around the central element 22 and the first concentric layer 36. A third concentric 37 may then be wound helically around the central element 22. Subsequent concentric layers, if any, similarly alternate the helical- and counter-helical rotation around the central element 22. By providing concentric layers of strands wound around the central element 22 in opposite directions, components of signal propagation not along the direction of the central element 22 will be summed and slowed from the perspective of surrounding dielectric material. So for example, an electromagnetic signal may be applied to the conductor 20 for propagation in the positive x direction shown in FIG. 3. As the signal propagates along the first layer 36 of strands, it may create an electromagnetic field in the positive y axis direction, indicated in FIG. 3 as well as the positive x direction. Recall desired signal propagation direction is along the positive x axis direction shown in FIG. 3. The summed electromagnetic field of the x and y axis windings will progress along the center line of the conductor at a rate reduced in proportion to the accumulated strand length determined by the formula.

Each strand of the second concentric layer 42 includes a diameter or other transverse dimension and a length. The strands of the first concentric layer 36 may have the same diameter. The strand diameter of the second concentric layer 42 of strands may be equal to the strand diameter of the first concentric layer 36 of strands. Otherwise, the strand diameter of the second concentric layer 42 of strands may be larger than the strand diameter of the first concentric layer 36 of strands. The length of the strands in the second concentric layer 42 is approximately equal to the length of the strands in the first concentric layer 36. The strands in the plurality of layers 26 may be individually insulated depending on the application as discussed above.

The conductor 20 may have any number of additional layers of strands of progressively increasing in cross-sections. In the conductor 20, the cross-sectional dimension of the strands increases progressively toward the outer circumference, whereby the above-discussed advantages are achieved. The strand layers 36, 42 may be utilized with or without a preferred strand sizing according to which the strand cross-sections are relatively sized to conform as closely as possible to the golden ratio progression of 1 to approximately 1.618. That is, the cross-sectional area of each strand in a next layer may be approximately 1.618 times the cross-sectional area of strands in a previous layer. The golden ratio progression may be of the kind disclosed in U.S. Pat. No. 4,980,517, titled "Multi-Strand Electrical Cable," and hereby incorporated by reference in its entirety for any purpose.

A layer of dielectric material 24 encases the plurality of strands 26 shown in FIGS. 1-3. The dielectric material 24 may be any material that is a poor conductor of electricity. The dielectric material may include rubber, cotton, Teflon, paper, pvc or other materials suitable for this function. Electromagnetic fields have a velocity of propagation (VoP) in the dielectric material 24. The VoP is a parameter that characterizes the speed to which the signal propagation is limited in the dielectric material. The VoP of the dielectric material 24 depends on a dielectric constant of the dielectric material 24. More specifically, the VoP is proportional to an inverse of the square root of the dielectric constant of the dielectric material 24 as shown in the following equation:

$$\text{VoP}=100/\textit{sqrt DC} \quad \text{(Equation 1)}$$

wherein DC is the dielectric constant. Equation 1 expresses VoP as a percentage of the speed of light. For example, for TFE, the dielectric constant is 2, and the velocity of propagation calculated according to Equation 1 is therefore 70.71%, indicating that an electromagnetic wave will propagate in the TFE at 70.71% of the speed of light. Dielectrics with a high air content may have a VoP of approximately 82%. For some foam dielectrics, the VoP may approach around 90%. For conductive materials, the VoP is generally assumed to be 100%. Embodiments of the present invention provide conductors with conductive strands having a longer effective length than the length of the conductor, effectively slowing the VoP in the conductive strands as measured along the length of the conductor to be closer to the VoP in the associated dielectric material.

The VoP is used to determine the lengths of the first and second concentric layers 36, 42 of strands. As stated above, the length of the first concentric layer 36 of strands is approximately equal to the length of the second concentric layer 42 of strands. These lengths may be expressed by the following formula:

$$L_{L1}=L_{L2}\approx(1/\text{VoP})*100*L_{CM} \quad \text{(Equation 2)}$$

wherein $L_{L1}$ is the length of the first concentric layer 36 of strands, $L_{L2}$ is the length of the second concentric layer 42 of strands, VoP is the velocity of propagation of the dielectric material 24, and $L_{CM}$ is the length of the central member 22. This is also generally the length of the conductor 20.

Strands in the first concentric layer 36 are wound around the central member 22 a number of turns per inch (TPI) along its length. The number of TPI per layer is chosen such that the length of strands in each layer is approximately equal, and the length of the strands is distributed evenly across the length of the conductor. The number of TPI may be calculated as follows:

$$L_{CM}+(\text{Mean } C\times\text{TPI})=(L_{L1}-L_{CM})/\text{Mean } C \quad \text{(Equation 3).}$$

In substituting equation 1 into equation 2 for $L_{L1}$, we obtain $$\text{TPI}\approx[((1/\text{VoP})*100*L_{CM})-L_{CM}]/\text{Mean } C \quad \text{(Equation 4)}$$

wherein TPI is the turns per square inch, $L_{L1}$ is the length of the first concentric layer 36 of strands, $L_{CM}$ is the length of the central member 22, and Mean C is the mean circumference of the first concentric layer 36 of strands.

The mean circumference may be defined as follows:

$$\text{Mean } C\approx(C_{L1}+C_{CM})/2 \quad \text{(Equation 5)}$$

wherein Mean C is the average circumference between the first strand layer 36 and the conductor 20, $C_{L1}$ is the circumference of the first concentric layer 36, and $C_{CM}$ is the circumference of the central member 22.

Strands in the second concentric layer 42 are wound a different number of TPI around the first layer 36, as shown in FIG. 3. The number of TPI for the second layer is chosen based on the diameter of the strands and layers such that the length of strands in the second layer is approximately equal to the length of strands in the first layer. The number of TPI for the second concentric layer 42 of strands may be calculated as follows:

$$\text{TPI}\approx L_{L2}-L_{CM}/\text{Mean } C \quad \text{(Equation 6)}$$

wherein TPI is the turns per square inch, $L_{L2}$ is the length of the second concentric layer 42 of strands, $L_{CM}$ is the length of the central member of strands, and Mean C is the mean circumference of the second concentric layer of strands. The TPI for the second concentric layer 42 of strands is less than the TPI for the first concentric layer 36 of strands.

The mean circumference of the second concentric layer of strands be defined as follows:

$$\text{Mean } C\approx(C_{L2}+C_{L1})/2 \quad \text{(Equation 7)}$$

wherein Mean C is the average circumference between the first concentric layer 36 of strands and the second concentric layer 42 of strands, $C_{L2}$ is the circumference of the second concentric layer 42 of strands, and $C_{L1}$ is the circumference of the first concentric layer 36 of strands.

The following chart provides exemplary values for a conductor, as shown in FIG. 1, having four layers of strands encircling a central strand. For the example below, the dielectric material is Teflon, which has a velocity of propagation of 70%, the central strand has a length equal to 1 inch, and Equation 4 defines TPI. In the following chart, 'L' indicates the layer number, 'OD' refers to an outside diameter of the layer, 'Mean C' refers to the mean circumference of the layer, 'TPI' refers to a number of twists per inch; 'AWG' refers to the approximate wire gauge of the layer considered as a whole, a measure proportional to the cross-sectional diameter or cross-sectional area of the layer, 'CMA' refers to the circular mil area, the cross-sectional area of each strand in the layer, and 'SD' refers to the number of strands×the gauge of each strand in the layer. As can be seen in the table below, to keep the length of strands in each layer constant, the turns per inch decreases as the layer outer diameter increases. The turns per inch and outer diameters in the table below are chosen such that the resultant length of strands, approximately equal in each layer, will slow the propagation of electric fields along the conductor to better match velocity of propagation in teflon.

Strand Chart for a Teflon Example

| L | OD | MEAN C | TPI | AWG | CMA | SD |
|---|---|---|---|---|---|---|
| 0 | .003 | 0 | 0 | 40 | 9.61 | 1 × 40 |
| 1 | .011 | .022 | 18.2 | 30.5 | 80 | 5 × 38 |
| 2 | .021 | .050 | 8 | 25 | 225 | 9 × 36 |
| 3 | .034 | .087 | 4.63 | 21 | 516 | 13 × 24 |
| 4 | .050 | .113 | 3 | 17.5 | 1024 | 16 × 32 |

Figure 4:
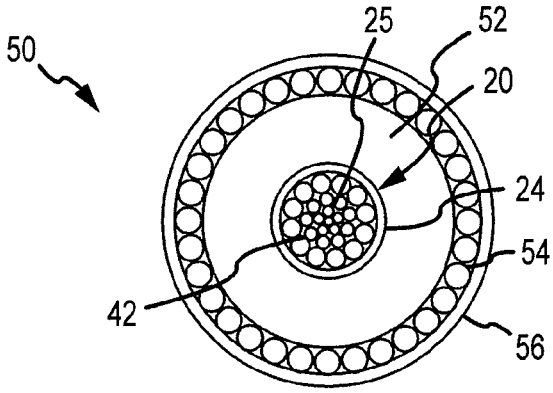
FIG. 4 is a cross-sectional view of an exemplary co-axial cable having the conductor in FIG. 1.
Figure 5:
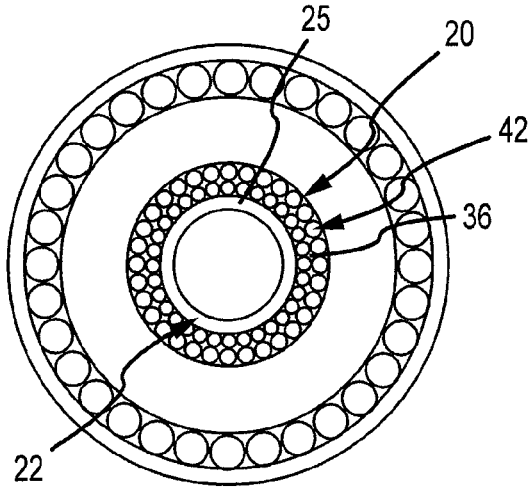
FIG. 5 is a cross-sectional view of an exemplary co-axial cable having the conductor in FIG. 2.

In one embodiment, the conductor 20 may be included in a co-axial cable 50, as shown in FIG. 4. The conductor may have the conducting central member 23. The co-axial cable 50 includes the conductor 20, an insulation member 52 surrounding the conductor 20, a ground layer of strands 54 enclosing the insulation member 52, and an outer insulation member 56 surrounding the ground layer 54. In an alternative embodiment, the conductor 20 having the non-conducting central member 25 as shown in FIG. 5.

Figure 6:
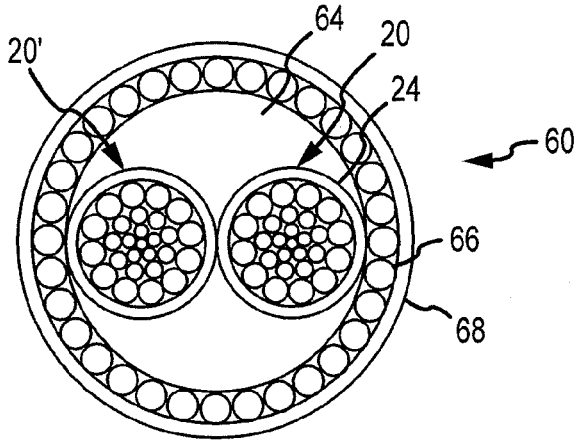
FIG. 6 is a cross-sectional view of an exemplary multi-axial cable having at least two conductors with each having a conducting central member.
Figure 7:
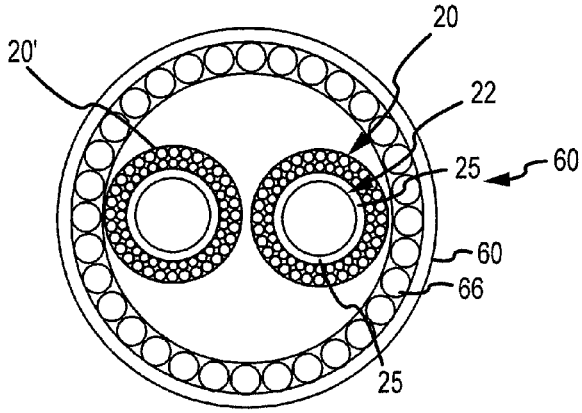
FIG. 7 is a cross-sectional view of an exemplary multi-axial cable having at least two conductors with each having a non-conducting central member.

In another embodiment, the conductor 20 may be used in a multi-axial cable 60, such as a twin-axial cable as shown in FIG. 6, having at least two conductors. The conductors 20 may each include the conducting central member 23. In an embodiment related to a twin-axial cable, the multi-axial cable 60 may include the conductor 20, a second conductor 20', an insulation member 64, a ground layer of strands 66, and an outer insulation member 68 surrounds the ground conductor 66. As shown in FIG. 7, the multi-axial cable 60 may alternatively include the conductors 20 each having the non-conducting member 25.

Figure 8:
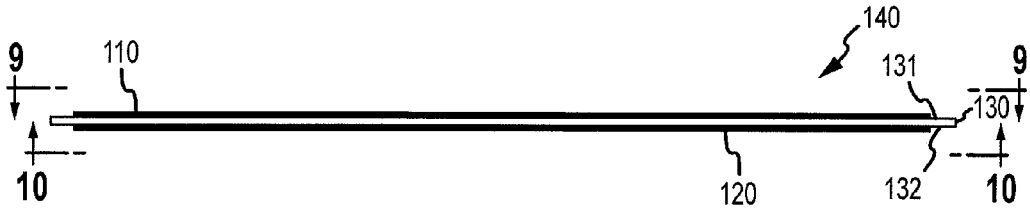
FIG. 8 is a cross-sectional view of an embodiment of a flat conductor having a two patterned conductive layers on either side of a non-conductive film.

Further embodiments of the present invention provide conductors that may be flat, where length in the conductive strands is achieved by patterning a conductive layer on a substrate. The conductive layer is patterned so that each conductive strand has a length such that propagation in the conductive strands along the conductor approximately equals a propagation velocity in an associated dielectric material. FIG. 8 depicts an embodiment of a conductor 140 constructed in this manner. A sheet 130 of non-conductive material, such as mylar or polypropylene, has opposite first and second sides 131 and 132. The sheet may have a width ranging from 0.4 to 6 mil and preferably ranging from 1 to 3 mil. Patterned conductive layers 110 and 120, each having a width ranging from 0.0004 mil to 6 mil depending on application are formed on the first and second sides 131 and 132, respectively. The patterned conductive layers 110 and 120 each include a plurality of individual conductive strands of equal length formed of a conductive material.

Figure 10:
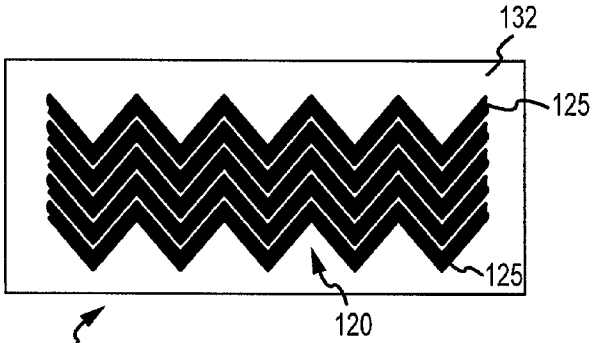
FIG. 10 is a plan view of the conductor of FIG. 8 along the line 10-10.
Figure 9:
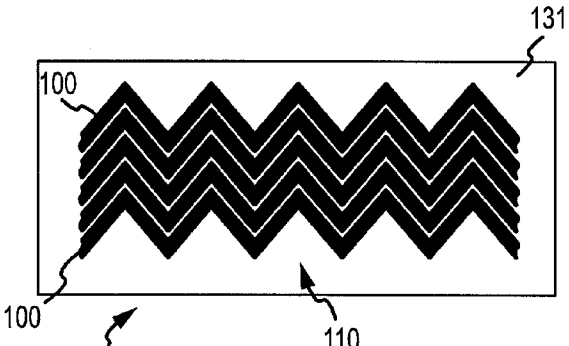
FIG. 9 is a plan view of the conductor of FIG. 8 along the line 9-9.

Patterned conductive layers 110 and 120 are shown in FIGS. 9 and 10, respectively. FIG. 9 is a plan view of the conductor 140 of FIG. 8 taken along the line 9-9. FIG. 10 is a plan view of the conductor 140 of FIG. 8 taken along the line 10-10. Patterned conductive layer 110 includes a plurality of strands 100 of conductive material, several of which are identified in FIG. 9. The strands 100 are patterned to increase their length and improve matching between the velocity of propagation in the conductive strands 100 and an associated dielectric material with which the conductor 140 may be used. Similarly, patterned conductive layer 120 includes a plurality of conductive strands 125, angled to improve matching between the velocity of propagation in the conductive strands 125 and a dielectric material with which the conductor 140 may be used.

The conductive strands 100 and 125 may be patterned through any known methods, including etching or other material removal techniques. Alternatively, in some embodiments, patterned conductive strands 100 and 125 are deposited in a pattern on the dielectric material 130. Conductive strands 100 and 125 may be oriented in opposite directions on opposite sides of the dielectric material 130 as shown in FIGS. 9 and 10 and shown schematically in FIG. 10A. FIG. 10A depicts a top-down plan view of the conductor 140. The strands 100 and 125 are shown schematically as lines and further separated for ease of illustration. Strands 125 are disposed on an opposite side of the non-conductive material 130 as the strands 100, as shown in FIG. 8, and in FIG. 10A the strands 125 on the opposite side of the non-conductive material 130 are shown as dashed lines. As shown in FIG. 10A, the strands 125 and 100 form a criss-cross pattern. The mirror imaged strand layers sum their respective fields to a common vector. The resultant summed field is slowed to better match velocity of propagation in an associated dielectric.

Figure 11:
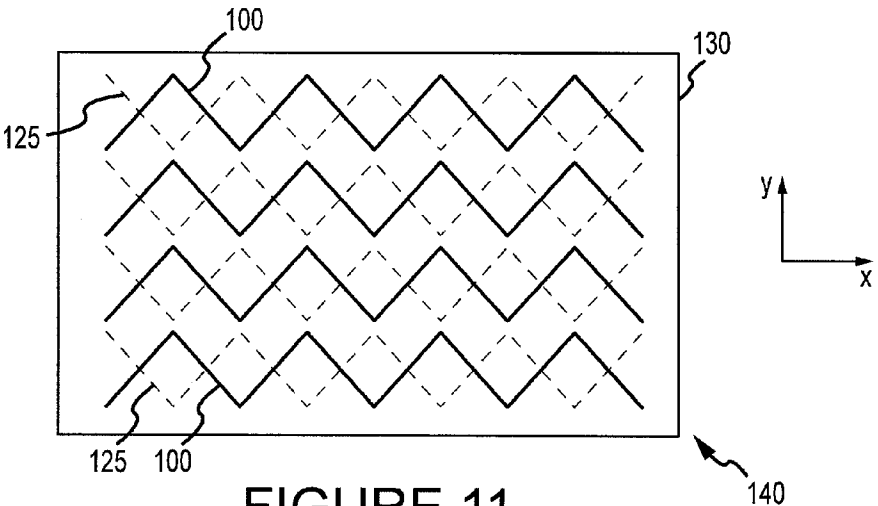
FIG. 11 is a schematic plan view, similar to FIG. 9, of the conductor of FIG. 8.
Figure 12:
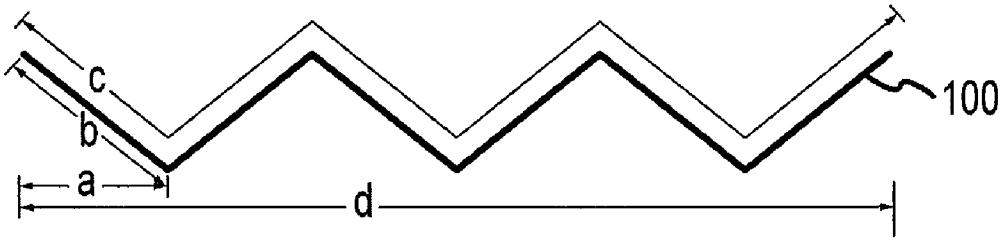
FIG. 12 is a plan view of one of the patterned conductive strands in a patterned conductive layer of the conductor of FIG. 8.

The conductive strands 100 and 125 are patterned to increase their length relative to the length of the conductor 140. One of the plurality of strands 100 is shown in FIG. 11, and one of the plurality of strands 125 is shown in FIG. 12. Each of the illustrated strands 100 and 125 is patterned in a zig-zag such that the ratio of length b to length a is selected proportional to an inverse of the velocity of propagation in an associated dielectric material. Accordingly, the ratio of length c of the entire strand 100 or 125, respectively, to the length d of the conductor itself, is also proportional to the inverse of the velocity of propagation in an associated dielectric. In one embodiment, an angle of the conductive strands to a direction of propagation is about 52 degrees for matching with a dielectric such as teflon or polypropylene. Geometries other than a straight zig-zag, such as curved or other shapes, may be used in other embodiments.

Figure 13:
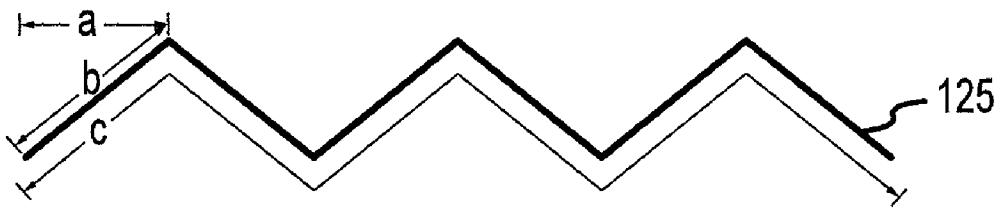
FIG. 13 is a plan view of one of the patterned conductive strands in a patterned conductive layer of the conductor of FIG. 8.
Figure 14:
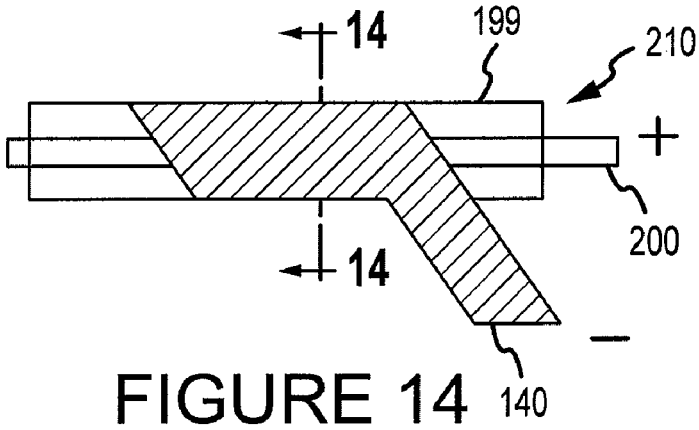
FIG. 14. is a side view of a coaxial cable utilizing the conductor of FIG. 8 as a negative or shield electrode.

Embodiments of the flat conductors described with reference to FIGS. 8-10A may be utilized to form cables, capacitors, or other devices having an associated dielectric. Recall the length of strands 100 and 125 in the conductor is chosen based on the velocity of propagation in the associated dielectric. One embodiment of the conductor 140 in use with an associated dielectric is shown in FIG. 13 depicting the use of the conductor 140 in a coaxial cable. The conductor 140 is wrapped around a dielectric material 199 that itself encases a central conductor 200 to form a coaxial cable 210. The conductor 200 may be similar to the conductor 140 in some embodiments, as is shown generally in FIG. 14, showing a cross-sectional view of the cable 210 of FIG. 13 along the line 14-14. The cable 210 includes the conductor 140 including patterned conductive layers 110 and 120 wrapped around the central dielectric material 199 and a second conductor, such as conductor 200, having a similar structure as the conductor 140. The conductor 200 includes, for example, non-conductive material layer 310 and conductive strands in two layers, 320 and 330.

Figure 15:
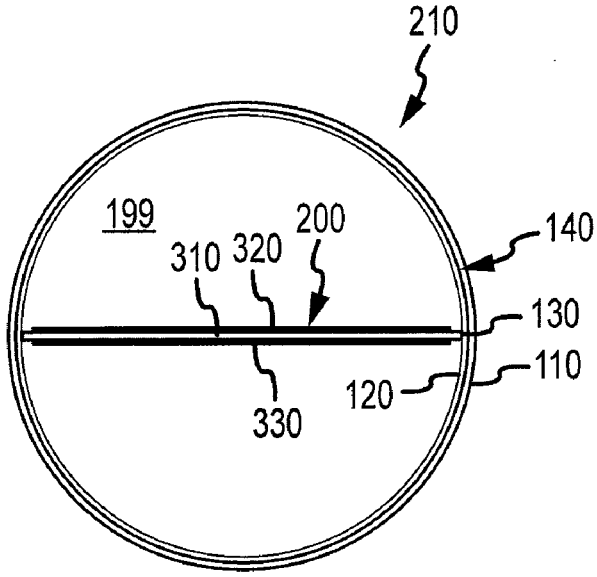
FIG. 15 is a cross-sectional view of the cable of FIG. 13 according to an embodiment of the present invention.
Figure 16:
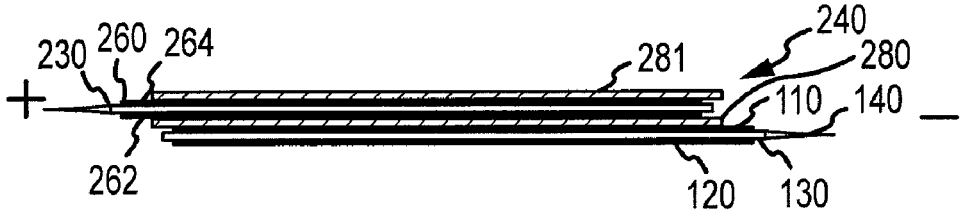
FIG. 16 is a side view of a capacitor employing the conductor of FIG. 8 as a negative electrode and a second conductor according to an embodiment of the present invention as a positive electrode.

Embodiments of conductors according to the present invention may further be used as one or more electrodes in a capacitor, as shown in FIG. 15 where conductors 140 and 230 form two electrodes of capacitor 240. The conductor 140, including a central non-conductive layer 130 and two patterned conductive layers 110 and 120, as shown in FIGS. 8-10, serves as a first negative electrode of the capacitor 240 in FIG. 15. A second conductor 230, substantially similar to conductor 140, also includes a central non-conductive material 260 having a first patterned conductive layer 262 on a first side of the central non-conductive material 260 and a second patterned conductive layer 264 on a second side of the central non-conductive material. As with the conductor 140, the patterned conductive layers 262 and 264 of the conductor 230 each include a plurality of conductive strands, for example like strands 100 and 125 described above, patterned such that a velocity of propagation in the conductive strands along a length of the conductor is approximately equal to a velocity of propagation in an associated dielectric material. The capacitor 240 is formed by placing a capacitor dielectric 280 between the first conductor 140 and the second conductor 230. The capacitor dielectric 280 is the associated dielectric material and velocity of propagation in the capacitor dielectric 280 will in part dictate the length of the conductive strands in the conductors 140 and 230. The length of the strands in the conductive layers 110, 120, 262 and 264 are chosen based on the velocity of propagation in the capacitor dielectric 280. A further layer of capacitor dielectric 281 may be provided such that the capacitor structure shown in FIG. 15 may be rolled up to form a completed capacitor structure.

Accordingly, one aspect of embodiments of the invention provides a constant and low inductance along a conductor. Lengths of conductive strands in the conductor are selected such that a wave propagation velocity along a length of the conductor approximately equal to the velocity of propagation in an associated dielectric. This is achieved by designing the conductor such that all conductive strand lengths are proportioned to the inverse of the dielectric's velocity of propagation. In one embodiment, the length is determined in part by a number of turns per unit length, whereby the number of turns on the layers is decreased as they reach the surface of the conductor to keep strand length approximately the same in each layer. This allows the impedance and wave propagation velocity of the conductor to be matched continuously rather than at intervals, thereby diminishing transmission losses, reducing resonance effects and persevering bandwidth.

Furthermore, in some embodiments of cables incorporating conductors according to embodiments of the present invention, a net velocity of propagation of the cable at length may be approximately equal to that of a conventionally stranded cable (that of the dielectric). However, at cable lengths shorter than a wavelength of the signal the impedance may be substantially more constant. Loss, signal distortion, noise and jitter may be reduced.

From the foregoing it will be appreciated that, although specific embodiments of the invention have been described herein for purposes of illustration, various modifications may be made without deviating from the spirit and scope of the invention.

The invention claimed is:

1. A conductor comprising a central element having a length, a plurality of insulated strands disposed about the central element in at least first and second concentric layers, a layer of a dielectric material having a velocity of propagation disposed around the plurality of insulated strands, each of the plurality of insulated strands having a conductive element and a layer of insulative material disposed around the conductive element and a length selected such that a velocity of propagation of an electromagnetic wave in the conductive element along the length of the central element is approximately equal to the velocity of propagation in the dielectric material.

2. The conductor of claim 1, wherein the length of each of the plurality of insulated strands is approximately equal to an inverse of the velocity of propagation of the dielectric material multiplied by the product of the length of the central element and the number one hundred.

3. The conductor of claim 1, wherein the central element includes a conductive central strand.

4. The conductor of claim 1, wherein the central element is made of a nonconductive material.

5. The conductor of claim 1, wherein the first and second concentric layers include an outer layer of strands and an intermediate layer of strands.

6. The conductor of claim 5, wherein the intermediate layer of strands has a first number of turns per inch and the outer layer of strands has a second number of turns per inch that is different from the first number of turns per inch.

7. The conductor of claim 6, wherein the intermediate layer of strands has a length and a mean circumference and wherein the first number of turns per inch is approximately equal to the difference between the length of the intermediate layer of strands minus the length of the central element divided by the mean circumference of the intermediate layer of strands.

8. The conductor of claim 6, wherein the outer layer of strands has a length and a mean circumference and wherein the second number of turns per inch is approximately equal to the difference between the length of the outer layer of strands minus the length of the central element divided by the mean circumference of the outer layer of strands.

9. The conductor of claim 6, wherein the second number of turns per inch of the outer layer of strands is less than the first number of turns per inch of the intermediate layer of strands.

10. The conductor of claim 5, wherein the central element has a diameter and each strand in the intermediate layer of strands has a diameter greater than the diameter of the central element.

11. The conductor of claim 10, wherein the diameters of the strands in the intermediate layer are substantially constant.

12. The conductor of claim 5, wherein each strand in the intermediate layer of strands has a diameter and each strand in the outer layer of strands has a diameter different than the diameter of each strand in the intermediate layer.

13. A conductor for use with an associated dielectric material having a velocity of propagation, the conductor comprising a nonconductive film having a length and a first side and a second side, a first conductive layer on the first side including a plurality of conductive strands each patterned such that a length of the conductive strands is greater than the length of the nonconductive film, the conductive strand length being proportional to an inverse of the velocity of propagation in the dielectric material.

14. The conductor of claim 13, wherein the plurality of conductive strands in the first conductive layer each have a first pattern including an angle of approximately 52 degrees with respect to a direction of propagation along the conductor.

15. The conductor of claim 13, wherein the nonconductive film is polypropylene.

16. The conductor of claim 14, further comprising a second conductive layer on the second side, the second conductive layer including a second plurality of conductive strands having a length equal to the length of the first plurality of conductive strands, the second plurality of conductive strands having a second pattern opposing the first pattern.

17. A cable comprising a conductive member, a central element having a length, a plurality of insulated strands disposed about the central element in at least first and second concentric layers, a dielectric material having a velocity of propagation disposed between the conductive member and the plurality of insulated strands, each of the plurality of insulated strands having a conductive element and a layer of insulative material disposed around the conductive element and a length approximately equal to an inverse of the velocity of propagation multiplied by the product of the length of the central element and the number one hundred.

18. The cable of claim 17, wherein the conductive member is an additional central element and an additional layer of strands disposed around the additional central element.

19. The cable of claim 17, wherein the conductive member is a conductive shield extending around the dielectric material and the plurality of insulated strands.

20. The cable of claim 17 further comprising a coaxial member and a sheath enclosing the layer of dielectric material and the coaxial member.

21. The cable of claim 20, wherein the coaxial member includes an additional central element having a length, an additional plurality of insulated strands disposed about the central element in at least first and second additional concentric layers, an additional layer of a dielectric material having a velocity of propagation disposed around the additional plurality of insulated strands, each of the additional plurality of insulated strands having an additional conductive element and an additional layer of insulative material disposed around the additional conductive element and a length approximately equal to an inverse of the velocity of propagation of the additional layer of the dielectric material multiplied by the product of the length of the additional central element and the number one hundred.

* * * * *